US005235371A

United States Patent [19]

Samuels et al.

[11] Patent Number: 5,235,371

[45] Date of Patent: Aug. 10, 1993

[54] MODIFICATION OF FILM PROCESSOR CHEMISTRY PROPORTIONAL HEATING DURING REPLENISHMENT

[75] Inventors: James T. Samuels, Rochester; Michael Newman, Pittsford, both of N.Y.

[73] Assignee: Eastman Kodak Company, Rochester, N.Y.

[21] Appl. No.: 759,454

[22] Filed: Sep. 13, 1991

Related U.S. Application Data

[63] Continuation-in-part of Ser. No. 738,664, Jul. 31, 1991, which is a continuation-in-part of Ser. No. 495,867, Mar. 19, 1990, Pat. No. 5,065,173, which is a continuation-in-part of Ser. No. 494,647, Mar. 16, 1990, Pat. No. 4,994,837.

[51] Int. Cl.[5] ..... G03D 3/06

[52] U.S. Cl. ..... 354/299; 354/324

[58] Field of Search ..... 354/299, 321, 322, 324

[56] References Cited

U.S. PATENT DOCUMENTS

| | | | |
|---|---|---|---|
| 3,922,701 | 11/1975 | Geyken et al. | 354/299 |
| 4,057,817 | 11/1977 | Korb et al. | 354/298 |
| 4,182,567 | 1/1980 | Laar et al. | 354/299 |
| 4,300,828 | 11/1981 | Kaufmann | 354/322 |
| 4,755,843 | 7/1988 | Foley | 354/299 |
| 4,994,837 | 2/1991 | Samuels et al. | 354/299 |
| 5,065,173 | 11/1991 | Samuels et al. | 354/298 |

OTHER PUBLICATIONS

Kenneth W. Oemcke, "Ambient Water Thermal Control System," Dept. of Mechanical Engineering, Rochester, N.Y., Jul. 1978.

*Primary Examiner*—A. A. Mathews
*Attorney, Agent, or Firm*—Warren L. Franz

[57] ABSTRACT

A temperature control system (10) of an automatic film processor (12) includes developer and fixer recirculation paths (30, 40) having thermowell heaters (34, 44) and thermistors (35, 45). The heating rate of a heating cycle is determined based on temperature measurements by the thermistor (35). The duty cycle of heater (34) is controlled in proportion to the difference between measured actual temperature and a preestablished setpoint temperature. When replenishment occurs, until the cooler slug of replenishment becomes mixed, heater duty cycle is chosen based on prereplenishment temperature as well as measured temperature. In a modified embodiment, until the slug is mixed, a single predefined heater duty cycle is set.

9 Claims, 7 Drawing Sheets

MODIFICATION OF FILM PROCESSOR CHEMISTRY PROPORTIONAL HEATING DURING REPLENISHMENT

This is a continuation-in-part of U.S. patent application Ser. No. 07/738,664, filed Jul. 31, 1991, entitled "Method and Apparatus for Out-of-Rate Error Detection In Film Processor Temperature Control System" which is a continuation-in-part of U.S. patent application Ser. No. 07/495,867, filed Mar. 19, 1990, entitled "processor With Speed Independent Fixed Film Spacing," now U.S. Pat. No. 5,065,173 which is a continuation-in-part of U.S. patent application Ser. No. 07/494,647, filed Mar. 16, 1990, entitled "Processor With Temperature Responsive Film Transport Lockout" (now U.S. Pat. No. 4,994,837). This application deals with subject matter similar to that of U.S. patent application Ser. No. 07/759,484, entitled "Method for Detecting Non-Valid States In Film Processor Temperature Control System," and Ser. No. 07/759,485, entitled "Control of Temperature in Film Processor In Absence of Valid Feedback Temperature Data filed on even date herewith, the disclosures of which are incorporated herein by reference.

TECHNICAL FIELD

The present invention relates to processors of film and similar photosensitive media, in general; and, in particular, to a method for the modification of normal proportional heating cycle operation after introduction of replenisher chemical in a system for controlling the temperature of chemicals in such a processor.

BACKGROUND ART

Photosensitive media processors, such as Kodak X-OMAT processors, are useful in applications like the automatic processing of radiographic films for medical imaging purposes. The processors automatically transport sheets or rolls of photosensitive film, paper or the like (hereafter "film") from a feed end of a film transport path, through a sequence of chemical processing tanks in which the film is developed, fixed, and washed, and then through a dryer to a discharge or receiving end. The processor typically has a fixed film path length, so final image quality depends on factors including the composition and temperature of the processing chemicals (the processor "chemistry"), and the film transport speed (which determines the length of time the film is in contact with the chemistry).

In a typical automatic processor of the type to which the invention relates, film transport speed is set at a constant rate and the chemistry is defined according to a preset recommended temperature, e.g. 94° F. (34° C.), with a specified tolerance range of +/− X°. A temperature control system is provided to keep the chemicals within the specified range, and means is provided for automatically replenishing the chemicals as they are used up.

Some processors use a thermowell located in a developer recirculation path to maintain a desired recommended developer chemical temperature. The thermowell has a cartridge heater inserted into one end of a hollow tubular body through which the developer is caused to flow by means of a pump. A thermistor protruding into the thermowell flow path serves to monitor the recirculating developer temperature. The duty cycle of the heater is varied, based upon data received from the thermistor, in proportion to the proximity of the measured actual temperature to a preestablished developer setpoint temperature. Until the setpoint temperature is reached, a "wait" light or similar annunciator signals the user that an undertemperature condition exists. Once the setpoint temperature is reached, heating and cooling cycles are initiated, as needed, in accordance with detected temperature variations from the setpoint. Cooling may be accomplished by operation of a solenoid valve which redirects the developer through a loop in the recirculation path which is in heat exchange relationship with cooler water in the wash tank. The fixer, whose temperature is less critical, may have its own thermowell recirculation path or may be maintained at a temperature close to the developer temperature by directing it in heat exchange relationship with the developer.

Processors have been introduced which are settable as to transport speed and chemistry temperature, so that the same processor can be used for multiple processing modes. A particular mode is often referred to by a shorthand designation indicative of its associated "drop time," which corresponds to the time lapse from entry of the leading edge of a film at the feed end of the processor, until exit of the trailing edge of the same film at the discharge end. Kodak uses the designations "Kwik" or "K/RA," "Rapid," "Standard," and "Extended" to refer to different user-selectable operating modes, each of which has its own characteristic transport speed and developer setpoint temperature.

The operations and functions of automatic film processors are handled under control of electronic circuitry, including a microprocessor connected to various process sensors and subsidiary controls to receive and dispense electronic signals in accordance with predefined software program instructions. Examples of such control circuitry are shown in U.S. Pat. No. 4,300,828 and in U.S. patent application Ser. No. 07/494,647. U.S. patent application Ser. No. 07/738,664, entitled "Method and Apparatus for Out-of-Rate Error Detection In Film Processor Temperature control system Jul. 31, 1991, describes a processor temperature control system in which malfunctions in operation of heating and cooling cycles are determined utilizing comparisons of actual and normal rates of change in chemical or dryer air temperature over time. U.S. patent application Ser. No. 07/759,484, entitled "Method for Detecting of Non-Valid States In a Film Processor Temperature Control System," filed on even date herewith, describes a method for verifying the validity of temperature measurement data based on comparisons of the measured actual temperatures of chemical with predictions as to what valid actual temperature states of the chemicals could be, given the heat gains (or losses) applied in the system during the time interval between measurements. The disclosures of those patent references are incorporated herein by reference.

In a typical processor of the type to which the invention relates, replenishment of developer or fixer chemical occurs automatically after a predetermined area of film has passed through the processor, and in response to a low level indicated by a chemical level sensor. Replenishment pumps are energized to introduce a slug of fresh developer or fixer from an external source of replenisher chemical. Because the external replenisher source is usually maintained at room temperature and it takes time for the newly introduced slug to mix with the chemical already in the tank, this presents problems for a temperature control system that utilizes a proportional heating cycle. When the unmixed slug of cold replenisher chemical comes into contact with the thermistor, a temperature is measured which does not reflect the temperature of the whole chemical. A duty cycle of a heater chosen based on the amount of deviation of such measured temperature from setpoint may provide a heating rate far in excess of that needed considering the temperature of the mass of fluid as a whole. This is especially troublesome where the duty cycle is chosen based on the temperature of a replenisher slug introduced when the chemical as a whole is already at or near setpoint. In such case, the application of too much heat may cause the temperature to overshoot the setpoint target, requiring the consequential activation of one or more, otherwise unnecessary, cooling cycles before the slug is fully mixed and the temperature is again stabilized.

DISCLOSURE OF THE INVENTION

It is an object of the present invention to provide a method for modifying the normal operation of a proportional heating cycle after introduction of replenishment chemical in a system for controlling the temperature of chemicals in an automatic film processor.

In accordance with the invention, a system for controlling the temperature of chemicals in an automatic film processor includes means for signalling the introduction of replenishment chemical into the processor and means, responsive to such signalling, for modifying the normal operation of a progressive heating cycle to select the heater duty cycle based on the temperature of the overall chemical, and not just the temperature of the replenisher slug.

An embodiment of the invention, described in greater detail below, is employed with a general purpose radiographic film processor having means for automatically transporting film through developer, fixer, wash and dryer stations according to a selected one of a plurality of available film processing modes, each having an associated characteristic film transport speed and developer setpoint temperature. Data corresponding to measured actual developer temperatures occurring at successive times is generated for control and diagnostic purposes under microprocessor supervision, based on measurements taken at periodic time intervals by a temperature sensor in contact with developer flowing in a recirculation path. A heater is controlled to maintain the temperature of the developer, with a heater duty cycle chosen based on the magnitude of the deviation of measured developer temperature from setpoint temperature. A signal indicative of the recent operation of a developer replenishment pump is used to modify normal heater control after introduction of a slug of replenisher developer, to select a heater duty cycle consistent with the temperature of the developer prior to replenishment.

BRIEF DESCRIPTION OF THE DRAWINGS

Embodiments of the invention have been chosen for purposes of illustration and description and are shown in the accompanying drawings, wherein.

Throughout the drawings, like elements are referred to by like numerals.

MODE OF CARRYING OUT THE INVENTION

Figure 2:
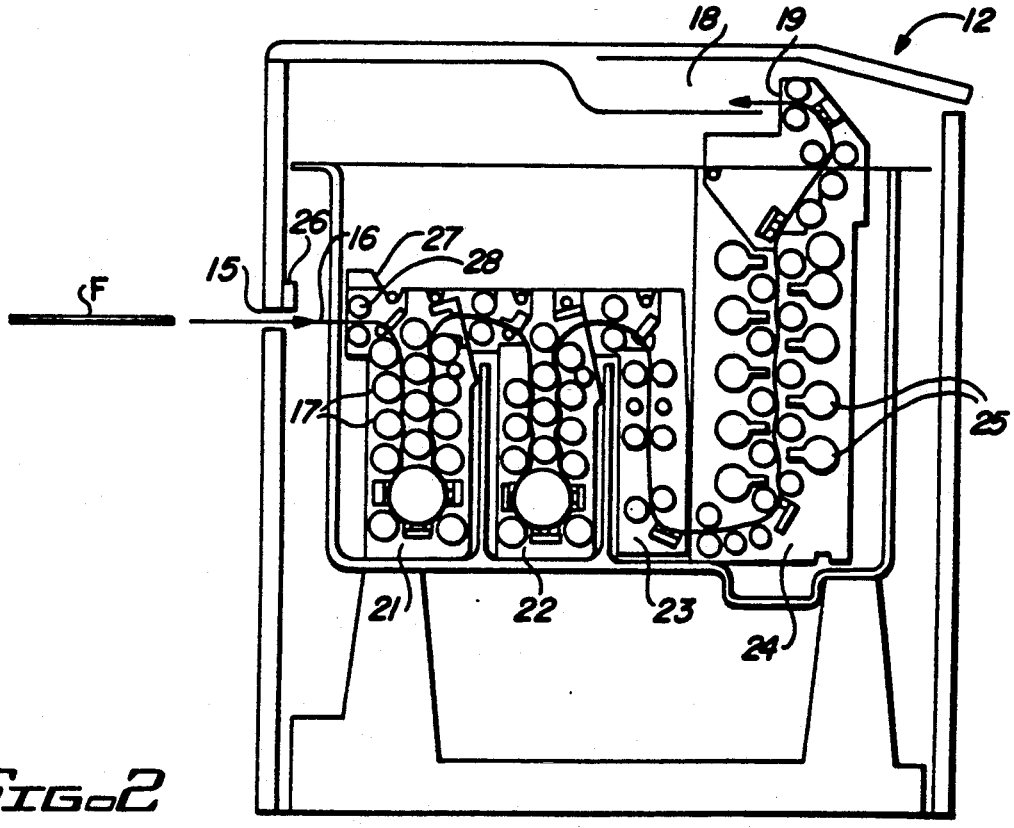
FIG. 2 is a schematic representation of relevant elements of the processor of FIG. 1.
Figure 3:
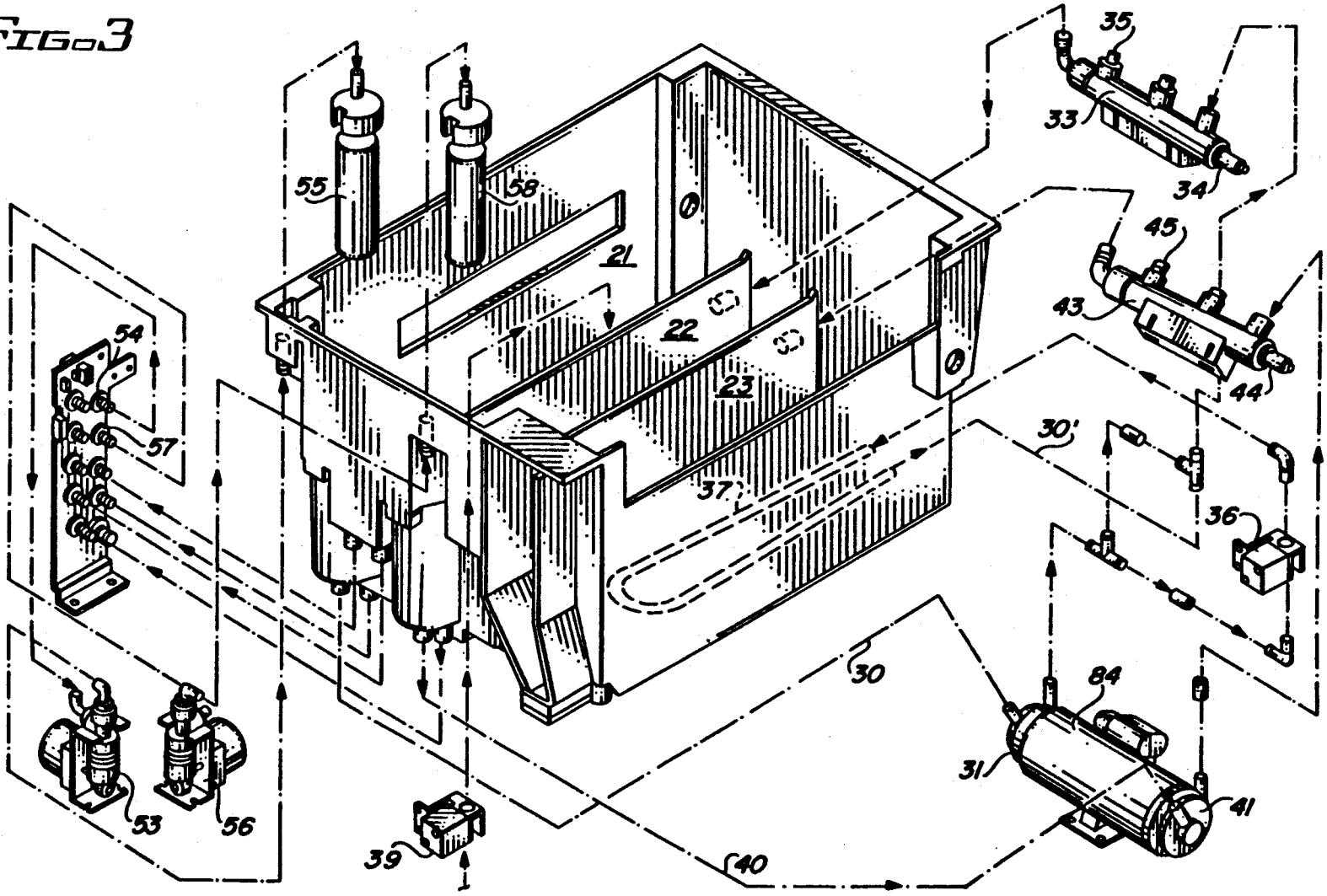
FIG. 3 is a schematic diagram showing the developer and fixer recirculation paths.

The principles of the invention are illustrated, by way of example, embodied in the form of a temperature control system 10 (FIGS. 3 and 4) suitable for use with a processor 12 (FIGS. 1 and 2) having four user-selectable film modes for the automatic processing of photosensitive film F (FIG. 2), such as for the development of radiographic images for medical diagnostic purposes. Associated with each mode are default parameters for transport speed; developer and fixer replenishment volumes; developer, fixer and dryer setpoint temperatures; and so forth. Such parameters are stored in memory, but can be modified through user input.

Figure 1:
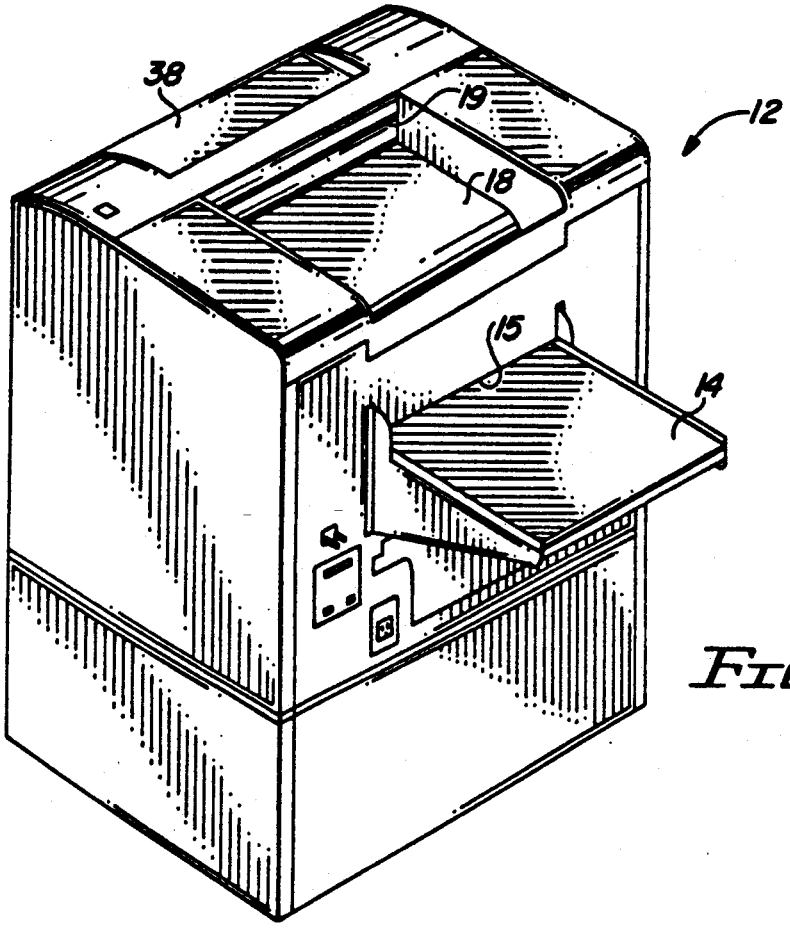
FIG. 1 is a perspective view of a processor in which a temperature control system incorporating the present invention can be employed.

The processor 12 has a feed tray 14 positioned ahead of an entrance opening 15 (FIG. 1). Patient film F (FIG. 2) entered through entrance opening 15 is transported through processor 12 along a travel path 16 (indicated by arrows in FIG. 2) by a network of conventional motor shaft-driven rollers 17, and eventually into a catch bin 18 at an exit opening 19. The path 16 includes travel through a developing station comprising a tank 21 filled with developer chemical; a fixing station comprising a tank 22 filled with fixer chemical; and a wash station comprising a tank 23 filled with wash water or comprising some other appropriate film washing device. Processor 12 also includes a drying station 24 comprising oppositely-disposed pluralities of air dispensing tubes 25 or other appropriate film drying mechanism.

Positioned proximate opening 15 is a sensor 26, such as a conventional reflective infrared LED sensor array, which provides a signal indicative of film width when film F is presented at the entrance opening 15. The film width sensor 26 also provides an indication of the occurrence of passage of the leading edge and trailing edge of film passing point 26 of the processor 12, since the signal from the sensor 26 will change significantly as each leading and trailing edge is encountered. A second sensor 27, in the form of a reed switch or the like, may be provided to detect separation of the entrance rollers 28 to signal the beginning of transportation of film F along the path 16.

The temperature of developer chemical in tank 21 may be controlled by means of a developer recirculation path 30 (shown in dot-dashed lines in FIG. 3) having a pump 31 for drawing developer out of tank 21, passing it through a thermowell 33 incorporating a heater 34 or other suitable heating device, and then passing it back to the tank 21. The path 30 also includes means for cooling the developer, such as a solenoid valve 36 which may be operated to redirect the developer through a loop 37 in heat exchange relationship with cooling water in water tank 23. The flow of water in tank 23 (see dot-dot-dashed lines in FIG. 3) is under control of a solenoid valve 39. A temperature sensor 35 (FIG. 4) is provided in the tank 21 or recirculation path 30 to monitor the temperature of the developer. The sensor 35 may, for example, be a thermocouple provided in the thermowell 33. Developer temperature may be displayed on a panel 38 (FIG. 1) located externally on the processor 12.

The temperature of fixer chemistry may be controlled in a similar manner by means of a fixer recirculation path 40 (shown in solid lines in FIG. 3) having a pump 41 for drawing fixer out of tank 22, passing it through a thermowell 43 incorporating a heater 44 or other suitable heating device, and then passing it back to the tank 22. A temperature sensor 45, such as a thermocouple similar to thermocouple 35, is provided in the tank 22 or recirculation path 40 to monitor the temperature of the fixer. Maintaining the setpoint temperature of the fixer is less critical than maintaining the setpoint temperature of the developer, so no cooling loop is provided.

The temperature of air in the dryer 24 can be maintained by energizing a blower motor 48 and air heater 49 (FIG. 4) to drive warm air through the tubes 25 (FIG. 2) and across the surface of film F. A temperature sensor 52, similar to thermocouple 35 or 45, may be located in the air path to monitor dryer air temperature. It will be appreciated that other ways of controlling processor chemistry and dryer temperatures may be employed.

Recirculation of developer and fixer takes place when the developer and fixer tanks 21, 22 are full. The "full" condition is detected by level sensing sensors 50, 51 (FIG. 4) located in communication with the tanks 21, 22. Developer and fixer replenishment occurs automatically if the level falls below a predefined desired level, and after each occurrence of the processing of a preset area of film F. Replenishment of developer is accomplished for the developer by energizing a replenishment pump 53 (FIG. 3) connected at its input side to a supply of replenishment developer 54 and at its output side to a filter assembly 55 located in fluid communication with the developer tank 21. For the fixer, replenishment is similarly accomplished by energizing of a replenishment pump 56 connected at its input side to a supply of replenishment fixer 57 and at its output side to a filter assembly 58 located in fluid communication with the fixer tank 22.

The sensors 50, 51 may be of a type having one contact in the form of a probe exposed to the solution and another contact grounded to the case of the heater 34 or 44. The probe can be located to monitor solution level in the main tank 21 or 22 or in an associated level-sensing auxiliary reservoir. When the probe becomes immersed in solution, a path is provided to ground and the resistance of the sensor circuit is lowered. The value of the lowered resistance indicates the level of the solution.

Figure 4:
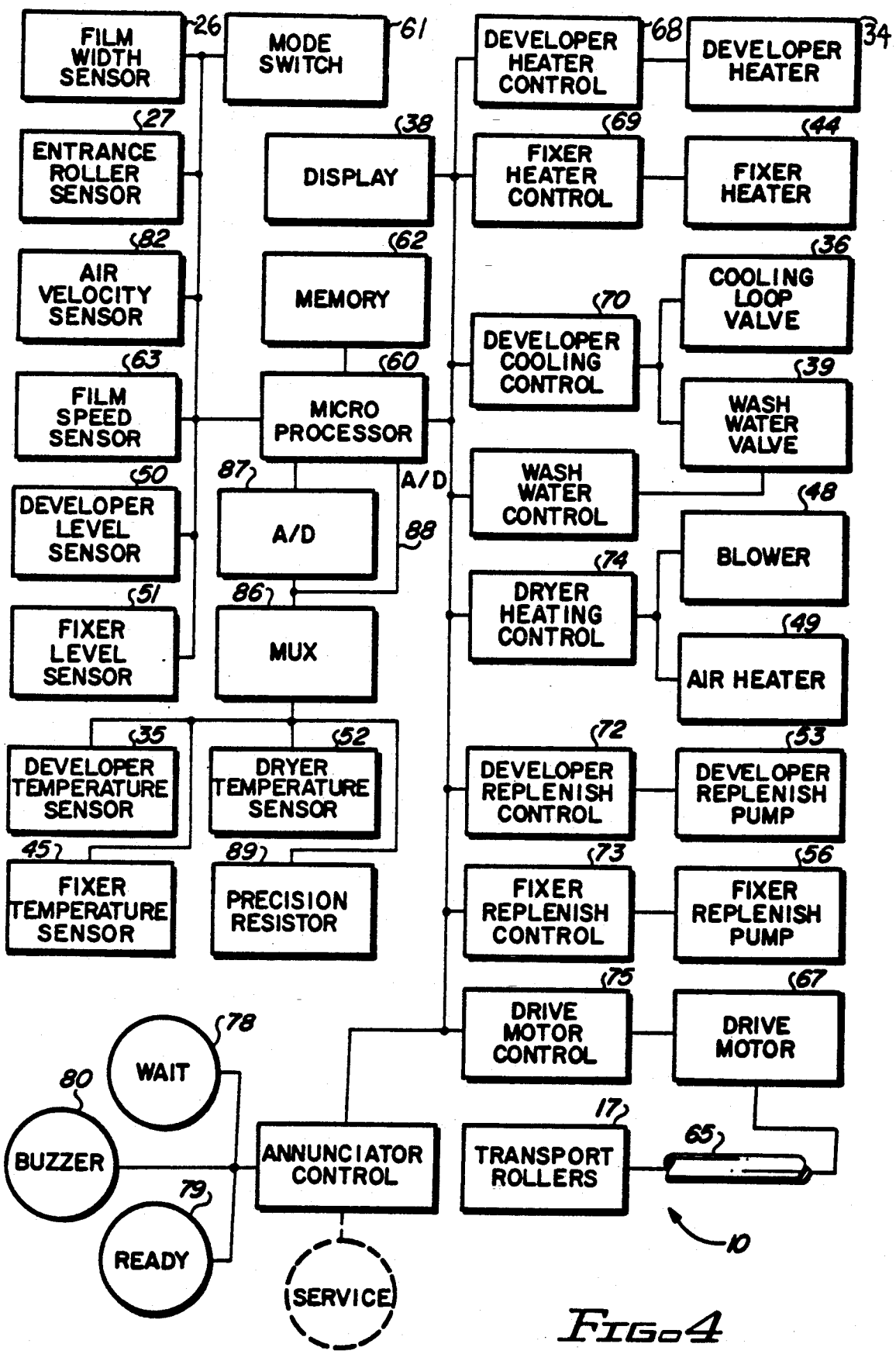
FIG. 4 is a block diagram of the control system employed in the processor.

FIG. 4 illustrates a control system usable in implementing an embodiment of the present invention. As shown, a microprocessor 60 is connected to direct the operation of the processor 12. Microprocessor 60 receives input from the user through a mode switch 61 as to what processor mode of operation is desired. The system can be configured to enable the user to select among predesignated modes, such as "Kwik" or "K/RA," "Rapid," "Standard," or "Extended" modes, each having predetermined associated film path speed and chemistry temperature parameters prestored in a memory 62. The system can also be configured to permit a user to input a desired path speed and temperature directly into memory 62.

Microprocessor 60 is connected to receive input information from the film width sensor 26, the entrance roller sensor 27, the developer, fixer and dryer temperature sensors 35, 45, 52, the developer and fixer level sensors 50, 51, and from various other sensors and feedback controls. The sensors 26, 27 provide the microprocessor 60 with information on the leading and trailing edge occurrences and the width of film F. This can be used together with film speed from a sensor 63 (FIG. 4) which measures the speed of shaft 65 of motor 67 used to drive the rollers 17 (FIG. 2), to give a cumulative processed film area total that guides the control of chemistry replenishment. The entrance roller sensor 27 signals when a leading edge of film F has been picked up by the roller path 16. This information can be used together with film speed and known length of the total path 16 to indicate when film F is present along the path 16.

As shown in FIG. 4, microprocessor 60 is connected to heater control circuitry 68, 69, cooling control circuitry 70, replenishment control circuitry 72, 73, dryer control circuitry 74, drive motor control circuitry 75 and annunciator control circuitry 77. Heater control circuitry 68, 69 is connected to heaters 34, 44, and cooling control circuitry 70 is connected to valves 36, 39 (FIGS. 3 and 4), to control the temperature of the developer and fixer flowing in the recirculation paths 30, 40 (FIG. 3) and, thus, the temperature of the developer and fixer in tanks 21, 22. Replenishment control circuitry 72, 73 is connected to valves 53, 56 to control the replenishment of developer and fixer in tanks 21, 22. Dryer control circuitry 74 is connected to dryer blower motor 48 and air heater 49 to control the temperature of air in dryer 24. Drive motor control circuitry 75 is connected to motor 67 to control the speed of rotation of drive shaft 65 and, thus, of rollers 17. This regulates the speed of travel of film F along film path 16 and, thus, determines the length of time film F spends at each of the stations (i.e., controls development, fixer, wash and dry times). Annunciator control circuitry 77 is connected to control the on/off cycles of annunciators in the form of a "Wait" light 78, a "Ready" light 79, and an audible alarm or buzzer 80.

Figure 5A:
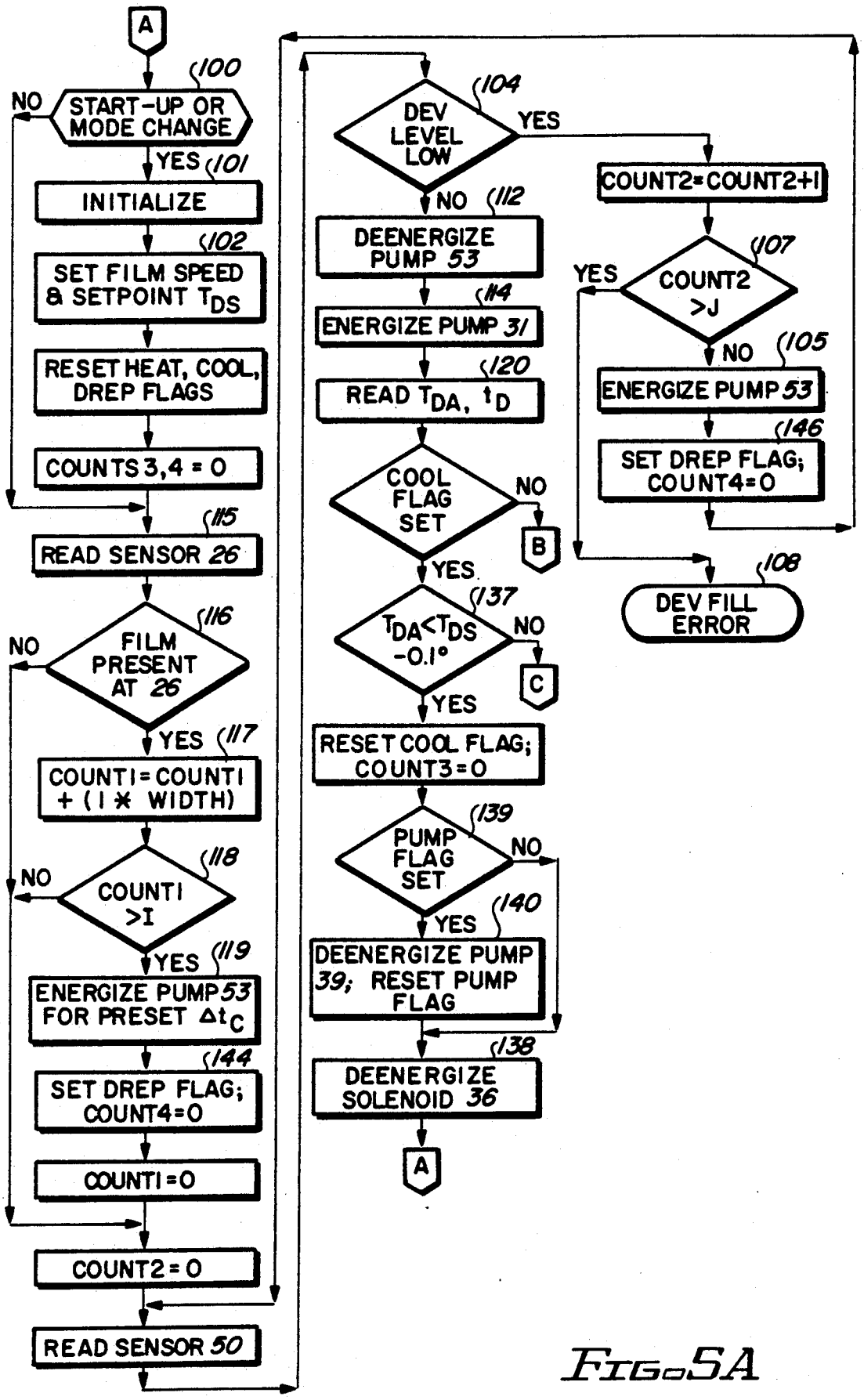
FIGS. 5A and 5B (hereafter collectively referred to as FIG. 5) are respective portions of a single flow diagram of the operation of the system of FIG. 4.
Figure 5B:
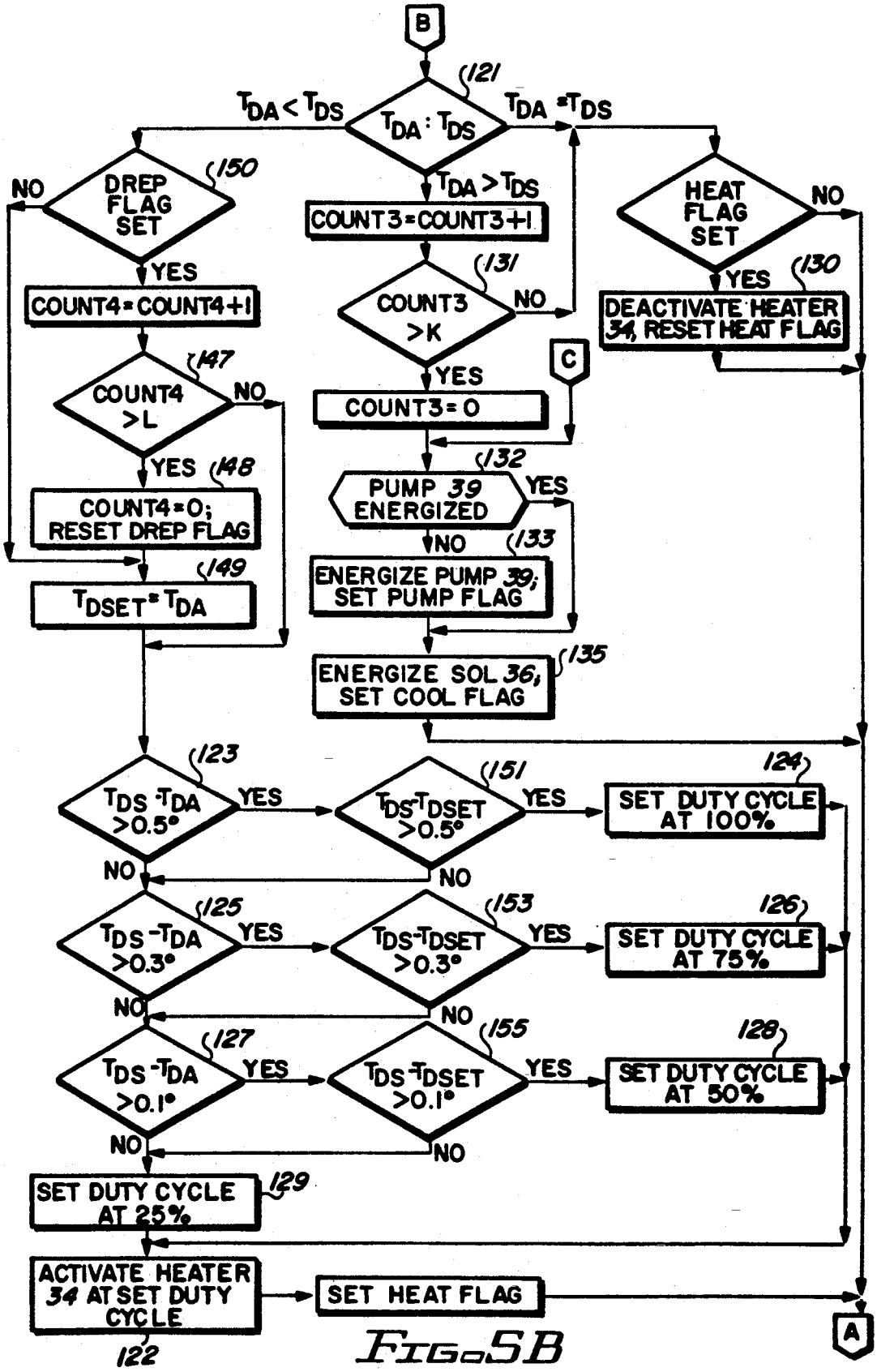

The operation of the control system 10 in accordance with the invention is described with reference to FIG. 5 for the control of temperature of chemical in developer tank 21. Control of the temperature of fixer in tank 22 can be done similarly, if desired.

When power is applied at start-up, or processor 12 is reset to a different mode (100 in FIG. 5), the system is initialized (101) and system variables, including film speed and setpoint temperature $T_{DS}$, are set (102). The wash water solenoid 39 is energized, allowing water to flow into the tank 23; and the developer solution level is checked by reading sensor 50 (103). If the level is low, a developer replenishment cycle is activated, as necessary, energizing pump 53 to fill the tank 21 (104, 106). If the developer level does not reach a preset target level within a predetermined time (e.g., count 2 =J =4 minutes), a tank fill error occurs (107, 108). If the correct level is reached, pump 53 is deenergized (112) and developer recirculation pump 31 is energized to flow the developer chemical along the recirculation path 30 (114). The system 10 is configured so that a replenishment cycle will also take place each time a preset area of film F has been processed. Film width sensor 26 at entrance opening 15 is read to determine the presence and width of film F as it passes into the processor 12 (115, 116). The cumulative film area is monitored (117) and, when the preset area is reached (118), pump 53 is energized for a preset time $\Delta t_c$ (119) to deliver a predetermined volume of replenisher chemical into the tank 21.

Microcomputer 60 uses algorithms and controls to monitor the temperatures of the developer, fixer and dryer air based on signals received from the sensors 35, 45, 52. The developer, fixer and dryer thermistors 35, 45, 52 may suitably be connected for shared component processing, to multiplexer circuitry 86 and an analog-to-digital (A/D) converter 87 (FIG. 4). The temperature conversions are monitored through a precision resistor 89, which is read at periodic intervals to verify the accuracy of the A/D conversion.

While the developer is recirculating (114), thermistor 35 in the thermowell 33 monitors actual developer temperature $T_{DA}$ at time $t_D$ (120). The resistance of the thermistor 35 changes inversely with the temperature of the solution. This data is sent to the microprocessor 60, which controls the heating and cooling systems.

The actual developer temperature $T_{DA}$ is determined by performing an analog-to-digital (A/D) conversion on the resistance of the thermistor 35. This data is then converted to a temperature of .C or .F by means of a software algorithm. The temperature is then compared to the setpoint temperature $T_{DS}$ previously stored in memory 62 to determine if heating or cooling is required (121). The temperature is read periodically at intervals of $\Delta t$, e.g., every $\frac{1}{2}$ or $\frac{3}{4}$ second.

Optimum processing quality occurs when the developer temperature is maintained substantially at its setpoint temperature $T_{DS}$. A tolerance of $\pm X°$, determined by user input or default, may be allowed (121). If the developer is below setpoint $T_{DS}$, the heater 34, located inside the thermowell 33, is controlled to pulse on and off at a duty cycle defined by microprocessor 60 based on the temperature data received from the thermistor 35 (122).

The heating of the developer is controlled by a proportional method. Heater 34 is turned on full until the temperature $T_{DA}$ measured by sensor 45 is within 0.5° of the preestablished setpoint $T_{DS}$. Heater 34 then operates on a duty cycle of 75%, until the temperature $T_{DA}$ measured by sensor 45 comes within 0.3° of the setpoint $T_{DS}$ (125, 126). Heater 34 then operates on a duty cycle of 50%, until the temperature $T_{DA}$ is within 0.1° of the setpoint $T_{DS}$ (127, 128). And, finally, heater 34 operates on a duty cycle of 25% as the setpoint temperature $T_{DA}$ is approached, until the temperature $T_{DS}$ is reached (127, 129). When the setpoint temperature $T_{DS}$ is reached, the developer heater shuts off (121, 130).

If the developer temperature $T_{DA}$ sensed by the sensor 45 is 0.3° or more than the setpoint $T_{DS}$ for $K=5$ consecutive readings, a cooling cycle is activated (121, 131). If not already energized, the wash water solenoid 39 is activated to flow water in the tank 23 around the heat exchanger loop 37 (132, 133). The developer cooling solenoid 36 is then energized (135), allowing developer in the recirculating path 30 to circulate through the loop 37. The cooler water in the tank 23 surrounding the heat exchanger 37 acts to cool the developer. The cooler developer then returns to the main recirculation path 30 and back to the tank 23. The cooling cycle continues until the developer temperature $T_{DA}$ drops to 0.1° below the setpoint $T_{DS}$ for one reading of the developer thermistor 35 (137). The developer cooling solenoid 36 then deenergizes, shutting off the developer supply to the heat exchanger 37 (138). If pump 39 was not already energized when the cooling cycle began, it too is shut off (139, 140). For most effective functioning of the developer cooling system, the temperature of water flowing in the wash tank 23 should preferably be at a temperature 10° F. (6° C.) or more below the operating setpoint $T_{DS}$ of the developer temperature.

The developer heating and cooling systems are responsible for maintaining the developer at the current processing mode temperature setpoint $T_{DS}$ under all operating conditions. The developer solution should stabilize at the setpoint temperature $T_{DS}$ within 15–20 minutes after start-up, and within 5 minutes after a mode change. In accordance with a procedure as disclosed in U.S. patent application Ser. No. 07/738,664, the actual temperature $T_{DA}$ and rate $R_{DA}$ of change of actual temperature $T_{DA}$ of the chemical can be monitored to ensure that it is within acceptable limits. Also, the validity of the actual measurements $T_{DA}$ can be verified, and invalid data disregarded for control purposes, in accordance with a procedure as disclosed in U.S. patent application Ser. No. 07/759,484.

Control of developer temperature using proportional heating may be adversely effected by the introduction of a slug of fresh developer at or near room temperature during a replenishment cycle. This is especially so when the developer has already reached a state of equilibrium close to the setpoint temperature $T_{DS}$. Should the cooler replenisher slug come into contact with the thermistor 35 in thermowell 33 before being fully mixed with the rest of the developer already in the processor 12, a temperature $T_{DA}$ much less than the actual temperature of the whole developer will be recorded (see point 91 in FIG. 7A). when this value is compared with the setpoint $T_{DS}$ at 121, conventional heater duty cycle selection procedures would set a higher duty cycle than necessary to recover from the slight overall cooling effect that will be seen after the slug has become fully mixed. Consequently, the application of too great a heat gain will cause the developer to overshoot the target setpoint temperature to a point 92 (FIG. 7A), at which time cooling (with perhaps one or more repetitions of heating followed by cooling) will have to be initiated to restore equilibrium at setpoint $T_{DS}$ at 93. Such temperature control operation is inefficient, and is avoided in accordance with the invention.

In accordance with the invention, the introduction of a slug of replenisher is noted in the control system and taken into account in setting the duty cycle of heater 34. For the embodiment of FIG. 5, the setting of a developer replenishment ("DREP") flag (144, 145) causes the heater duty cycle to be chosen based not only on the current temperature $T_{DA}$ (123, 125, 127, 129), but also on the temperature $T_{DSET}$ of the developer seen before the replenishment cycle occurred. The developer replenishment flag remains set for a period of time (count 4 $=L$) sufficient for the replenisher to be mixed enough to avoid the adverse effects of measuring the cooler temperature of the unmixed slug (147, 148).

Prior to replenishment, the value of $T_{DSET}$ is always the same as that of the currently measured temperature $T_{DA}$ (149). However, for the period of time after replenishment occurs and before the slug has sufficiently mixed (i.e. until count 4 $=L$), the value of $T_{DSET}$ remains at its prereplenishment value (147, 149, 150).

During this time, no duty cycle other than the lowest one (129) will be selected unless the deviations from the setpoint $T_{DS}$ of both the current actual temperature $T_{DA}$ and the prereplenishment actual temperature $T_{DSET}$ meet the requisite threshold criteria (123, 125, 127, 151, 153, 155). For example, even though the measured current actual temperature $T_{DA}$ following replenishment is less than the setpoint temperature $T_{DS}$ by more than 0.5° (151), a duty cycle of 100% (124) will not be set, unless the prereplenishment temperature $T_{DSET}$ was also less than the setpoint $T_{DS}$ by more than 0.5°. If the deviation from setpoint $T_{DS}$ of the historical temperature $T_{DSET}$ was greater than 0.3°, but not greater than 0.5°, a duty cycle of 75% will be set (125, 153, 126). If the deviation of $T_{DSET}$ was greater than 0.1°, but not greater than 0.3°, a 50% duty cycle will be set (127, 155, 128). And, if the historic value $T_{DSET}$ was within 0.1° of setpoint $T_{DS}$, a 25% duty cycle is set (127, 155, 129).

Figure 6:
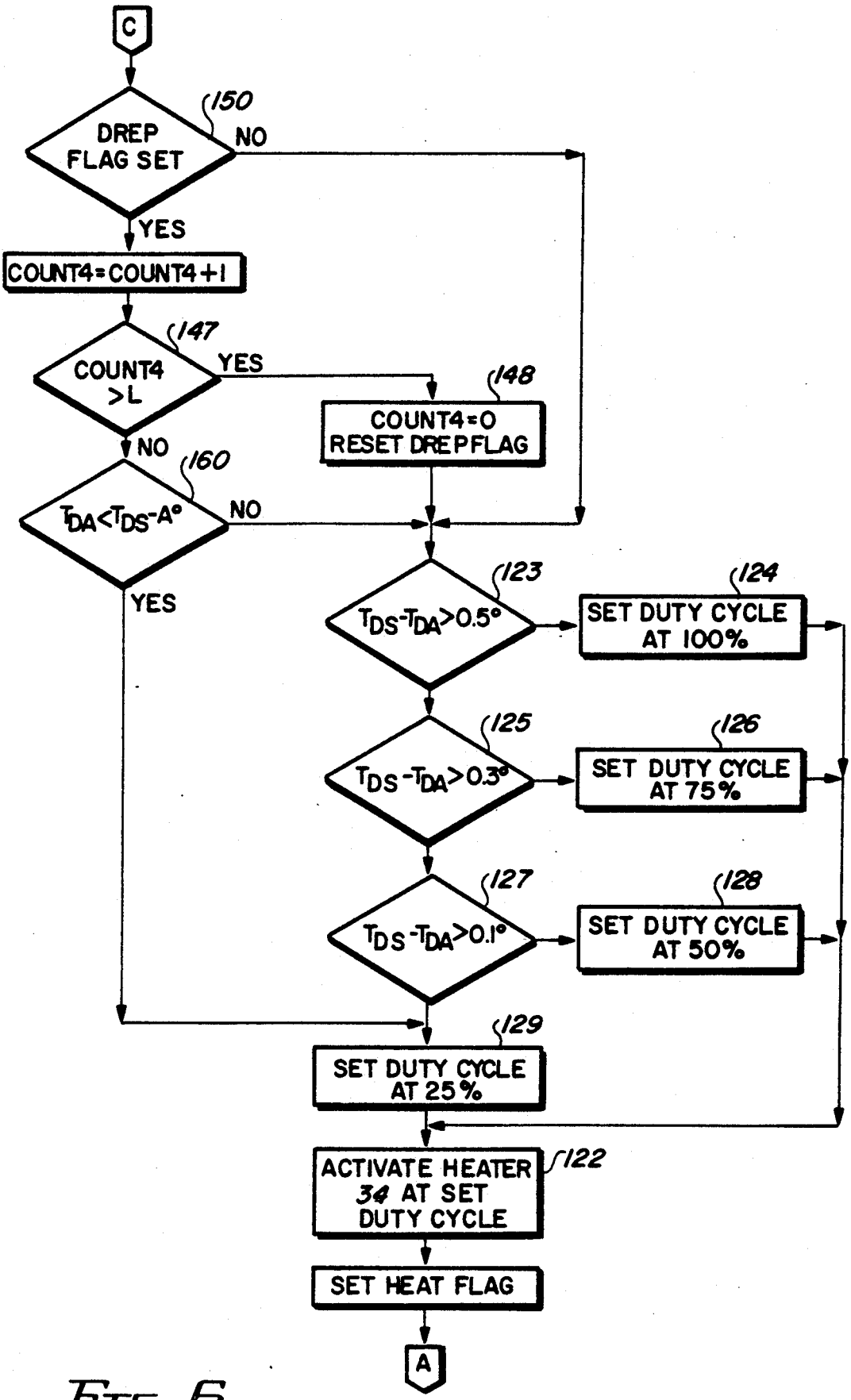
FIG. 6 is a modified form of a portion of the flow diagram of FIG. 5.

FIG. 6 shows a modified form of the heater duty cycle selection steps of the process of FIG. 5 wherein, during the period following replenishment and prior to mixing, unless the current measured actual temperature $T_{DA}$ is more than a given amount A° below setpoint $T_{DS}$ (160), the lowest duty cycle will always be set (129).

Figure 7A:
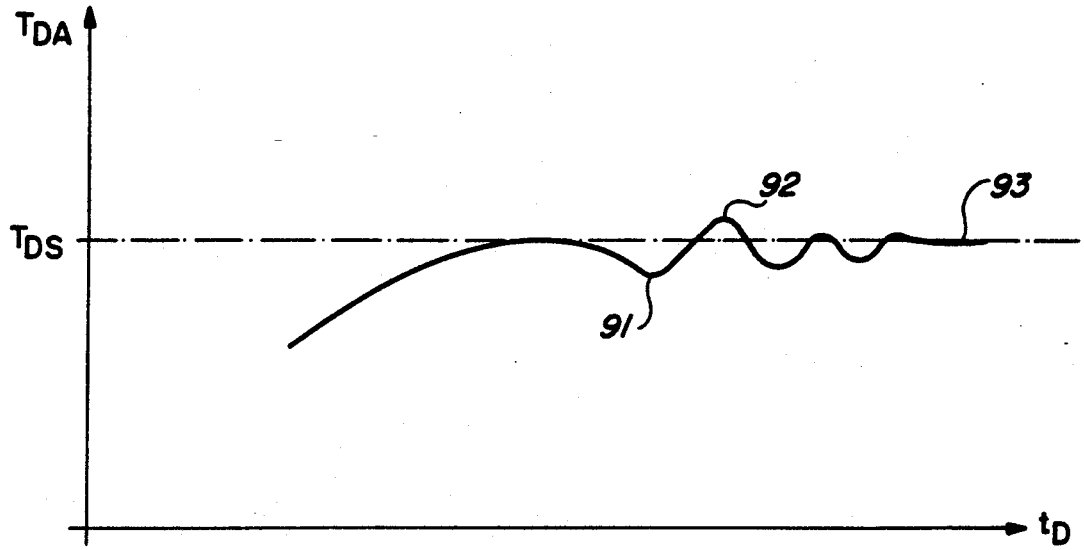
FIG. 7A (PRIOR ART)
FIGS. 7A and 7B are graphical representations of typical time variations of chemical temperature over time helpful in understanding the utility of the invention.
Figure 7B:
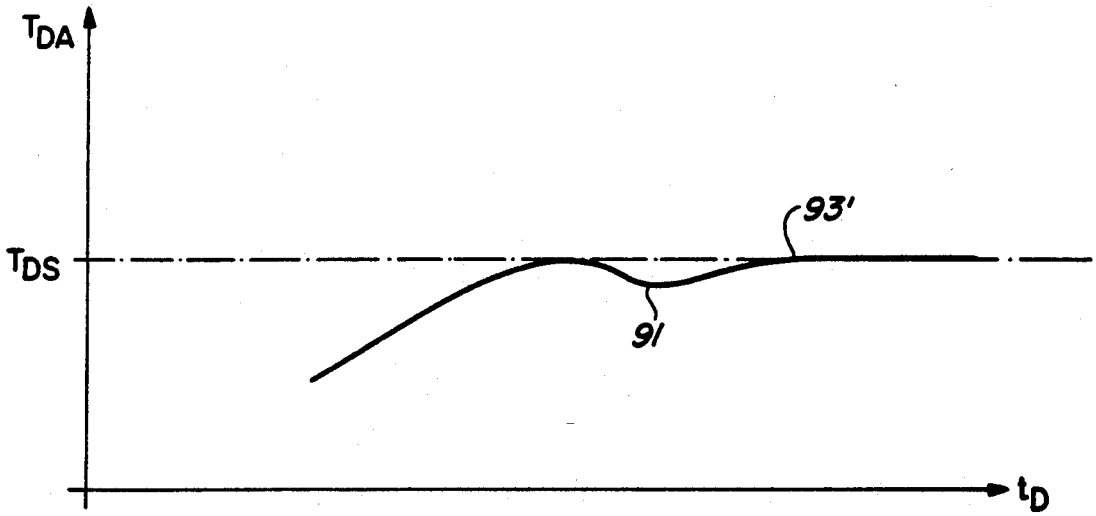

The effect of such replenishment modification on normal duty cycle selection can be seen by comparing FIGS. 7A and 7B. FIG. 7A, discussed above, shows conventional operation; FIG. 7B shows operation with the modification. The same dip in temperature $T_{DA}$ below setpoint $T_{DS}$ occurs in FIG. 7B at point 91 just as in FIG. 7A. However, the selection of a lower duty cycle, in accordance with the invention, shows a recovery to a point 93' in FIG. 7B, without overshoot and without the necessity for multiple repetitions of cooling and heating cycles.

The replenishment and temperature control cycles associated with the fixer chemical in tank 22 can be made similar to those associated with the developer tank 21. Tank 22 is both filled and replenished automatically from a connection 57 to a supply of fresh fixer solution. Like the developer, when tank 22 is full, fixer is recirculated continuously by a recirculation pump 41 through a thermowell 43 where a thermistor 45 monitors the temperature of the solution.

When the fixer solution is circulating in path 40, a heater 44 in the thermowell 43 maintains the temperature of the solution to increase its effectiveness. This is especially important to support the faster processing modes. The fixer temperature $T_{FA}$ is determined by performing an analog-to-digital (A/D) conversion on the resistance of the thermistor 45 using the same multiplexer circuitry 86, A/D converter 87, and internal A/D converter 88 as for the developer, above. This data is then converted to a temperature in ° F or ° C by microprocessor 60 by means of a software algorithm. The temperature is then compared to the setpoint $T_{FS}$ stored in memory 62 to determine if heating is required.

When the temperature $T_{FA}$ is below the setpoint $T_{FS}$, the heater is turned on. Like the developer, the fixer solution should stabilize at the setpoint temperature $T_{FS}$ within 15–20 minutes after start-up, and within 5 minutes after a mode change. The fixer heater 45 is normally operated at full capacity, without proportional regulation of its duty cycle; and the fixer, which operates more effectively at higher temperatures, does not have to be cooled. Nevertheless, there is no reason why proportional heating cannot be used for fixer temperature control, if desired. And, when this is done, regulation following fixer replenishment can proceed as described above for the developer, taking into account misrepresentative temperature readings caused by the cooler slug of fresh fixer.

As film F is transported through the dryer 24, air tubes 25 circulate hot air across the film F. The tubes 25 are located on both sides of the dryer 24 to dry both sides of the film at the same time. The dryer heater 49 heats the air to a setpoint temperature $T_{AS}$ within the range of 90°–155° F. (38°–65.5° C.) as set by the user or mode default parameters. The actual temperature $T_{AA}$ in the dryer is sensed by a thermistor 52 using the same multiplexer and A/D circuits 86, 87.

The air temperature $T_{AA}$ is determined by converting the resistance of thermistor 52 into ° F. or ° C. This value is then compared to the setpoint $T_{AS}$. If the temperature $T_{AA}$ is below the setpoint $T_{AS}$, the dryer blower 48 and dryer heater 49 are turned on. The blower 48 activates first, with the heater 49 following (this prevents damage to the heater) in response to activation of the vane switch 82 by the blower air. The heater 49 operates at full capacity. When the temperature $T_{AA}$ is above the setpoint $T_{AS}$, the dryer heater 49 is turned off.

As film F leaves the dryer 28, it passes through the exit opening 19 where it is transported out of the interior of the processor 12 and into the top receiving tray 18. If no new film F enters the processor, the processor will enter a standby mode approximately 15 seconds after a film has exited. In the standby mode the water supply is turned off, unless needed for developer cooling; the developer, fixer and dryer temperatures are maintained at their setpoints $T_{DS}$, $T_{FS}$ and $T_{AS}$; and the drive motor 67 is changed to standby operation.

Those skilled in the art to which the invention relates will appreciate that other substitutions and modifications can be made to the described embodiment without departing from the spirit and scope of the invention as described by the claims below.

What is claimed is:

1. A method for controlling temperature in the processing of exposed photosensitive media utilizing apparatus having means for automatically transporting said media from a feed point along a path through chemical, wash and dryer stations, a sensor for sensing the temperature of chemical at said chemical station, means for changing the temperature of said chemical, and means for introducing replenisher chemical to said chemical station; said method including the steps of:

establishing a reference chemical temperature $T_S$;

introducing a quantity of replenisher chemical to said chemical station utilizing said replenisher chemical introducing means;

sensing a series of actual temperatures $T_A$ of chemical located at said chemical station at particular respective times t, using said chemical temperature sensor; and regulating the temperature of said chemical with said chemical temperature changing means, using a heating rate normally set in proportion to the magnitude of the difference between said sensed actual temperatures $T_A$ and said reference temperature $T_S$;

and said method being characterized in that:

said method further comprises signalling the occurrence of said introduction of said replenisher chemical;

said sensing step comprises sensing an actual temperature $T_1$ at a particular time $t_1$ prior to introducing said replenisher chemical, and sensing an actual temperature $T_2$ at a particular time $t_2$ after introduction of said replenisher chemical; and said regulating step comprises modifying the normal setting of said heating rate in response to said signalling of said occurrence of said replenisher chemical introduction, to account for differences in temperature at said introduction, between the temperature of the replenisher chemical and the temperature of the chemical already at the station.

2. A method as in claim 1, wherein said regulating step comprises setting said heating rate at least in part based on said prereplenishment temperature $T_1$, in response to said replenisher chemical introduction signalling.

3. A method as in claim 2, wherein said regulating step comprises, in response to said replenisher chemical introduction signalling, setting said heating rate in proportion to both the difference between said prereplenishment temperature $T_2$ and the reference temperature $T_S$ and the difference between said prereplenishment temperature $T_1$ and the reference temperature $T_S$.

4. A method as in claim 1, wherein said signalling step comprises signalling the introduction of said replenisher until the temperature of said replenisher has become substantially the same as the temperature of the rest of said chemical at said station.

5. A method as in claim 1, wherein said regulating step comprises, in response to said replenisher chemical introduction signalling, setting said heating rate to a heating rate less than would be set in the absence of said signalling.

6. A method as in claim 1, wherein said regulating step comprises, in response to said replenisher chemical introduction signalling, setting said heating rate to a predefined single heating rate.

7. A method as in claim 6, wherein said regulating step comprises in response to said replenisher chemical introduction signalling, setting said heating rate to said predefined single rate whenever said current temperature $T_2$ is greater than a predefined temperature.

8. A method for controlling temperature in the processing of exposed photosensitive media utilizing apparatus having means for automatically transporting said media from a feed point along a path through developer, fixer, wash and dryer stations, a sensor for sensing the temperature of developer at said developer station, means for changing the temperature of said developer, and means for introducing replenisher developer to said developer station; said method including the steps of:

establishing a reference developer temperature $T_{DS}$;

introducing a quantity of replenisher developer to said station utilizing said replenisher developer introducing means;

sensing a series of actual temperatures $T_{DA}$ of developer located at said developer station at particular respective times $t_D$, using said developer temperature sensor; and regulating the temperature of said developer with said developer temperature changing means, using a heat rate normally set in proportion to the magnitude of the difference between said sensed actual temperatures $T_{DA}$ and said reference temperature $T_S$; said heating rate being normally set at a first rate for a first deviation of said temperature $T_{DA}$ from said temperature $T_{DS}$, and being normally set at a second rate, lower than said first rate, for a second deviation, less than said first deviation, of said temperature $T_{DA}$ from said temperature $T_{DS}$;

and said method being characterized in that:

said method further comprises signalling the occurrence of said introduction of said replenisher developer;

said sensing step comprises sensing an actual temperature $T_{D1}$ at a particular time $t_{D1}$ prior to introduction of said replenisher developer, and sensing an actual temperature $T_{D2}$ at a particular time $t_{D2}$ after introducing said replenisher developer; and said regulating step comprises, in response to said signalling of said replenisher developer introduction, setting said heat rate at said second rate unless both said temperatures $T_{D1}$ and $T_{D2}$ are less than said temperature $T_{DS}$ by more than said second deviation.

9. A method for controlling temperature in the processing of exposed photosensitive media utilizing apparatus having means for automatically transporting said media from a feed point along a path through developer, fixer, wash and dryer stations, a sensor for sensing the temperature of developer at said developer station, means for changing the temperature of said developer; and means for introducing replenisher developer to said developer station; said method including the steps of:

establishing a reference developer temperature $T_{DS}$;

introducing a quantity of replenisher developer to said station utilizing said replenisher developer introducing means;

sensing a series of actual temperatures $T_{DA}$ of developer located at said developer station at particular respective times $t_D$, using said developer temperature sensor; and regulating the temperature of said developer with said developer temperature changing means, using a heat rate set in proportion to the magnitude of the difference between said sensed actual temperatures $T_{DA}$ and said reference temperature $T_S$; said heating rate being normally set at a first rate for a first deviation of said temperature $T_{DA}$ from said temperature $T_{DS}$, and being normally set at a second rate lower than said first rate, for a second deviation, less than said first deviation, of said temperature $T_{DA}$ from said temperature $T_{DS}$;

and said method being characterized in that:

said method further comprises signalling the occurrence of said introduction of said replenisher developer; and said regulating step comprises, in response to said signalling of said replenisher developer introduction, setting said heat rate at said second rate, at least for some temperatures $T_{DA}$ deviating from said temperature $T_{DS}$ by more than said second deviation.

* * * * *